US007484306B2

(12) United States Patent
Emerson

(10) Patent No.: US 7,484,306 B2
(45) Date of Patent: Feb. 3, 2009

(54) STRAIGHT EDGE CLAMPING DEVICE

(76) Inventor: Eugene Emerson, 14116 High St., Whittier, CA (US) 90605

( * ) Notice: Subject to any disclaimer, the term of this patent is extended or adjusted under 35 U.S.C. 154(b) by 663 days.

(21) Appl. No.: 11/272,495

(22) Filed: Nov. 14, 2005

(65) Prior Publication Data

US 2007/0125040 A1 Jun. 7, 2007

(51) Int. Cl.
*B43L 7/00* (2006.01)

(52) U.S. Cl. ..... 33/403; 33/430

(58) Field of Classification Search ..... 33/32.1, 33/32.2, 40, 403, 430, 434, 436, 443; 408/97, 408/103, 107
See application file for complete search history.

(56) References Cited

U.S. PATENT DOCUMENTS

| | | | | |
|---|---|---|---|---|
| 917,488 | A | 4/1909 | Roberts | |
| 1,128,970 | A | 2/1915 | Godefroy et al. | |
| 2,497,733 | A | 2/1950 | Kebour | |
| 2,849,900 | A | 9/1958 | Heidtman, Jr. | |
| 3,534,639 | A | 10/1970 | Treichler | |
| 3,626,513 | A | 12/1971 | Pytlak | |
| 4,077,292 | A * | 3/1978 | Cole | 83/745 |
| 4,330,228 | A | 5/1982 | Beyl | |
| 4,394,800 | A | 7/1983 | Griset | |
| 4,466,601 | A | 8/1984 | Raines | |
| 4,490,920 | A | 1/1985 | Griset | |
| 4,499,667 | A | 2/1985 | Griset | |
| 4,842,453 | A | 6/1989 | Raines et al. | |
| 4,952,101 | A | 8/1990 | Coombs | |
| 4,955,766 | A | 9/1990 | Sommerfeld | |
| 5,155,918 | A * | 10/1992 | Hummer, Jr. | 33/430 |
| 5,308,199 | A | 5/1994 | Juang | |
| 5,348,276 | A | 9/1994 | Blacker | |
| 5,507,607 | A | 4/1996 | Ericksen et al. | |
| 5,676,500 | A | 10/1997 | Sommerfeld | |
| 5,791,835 | A | 8/1998 | Chiang et al. | |
| 6,050,559 | A | 4/2000 | De Souza | |
| 6,138,546 | A * | 10/2000 | Hursey | 83/875 |
| 6,254,320 | B1 | 7/2001 | Weinstein et al. | |
| 6,557,601 | B1 * | 5/2003 | Taylor | 33/497 |
| 2003/0233926 | A1 * | 12/2003 | Makropoulos | 83/829 |

* cited by examiner

*Primary Examiner*—G. Bradley Bennett
(74) *Attorney, Agent, or Firm*—Park Law Firm John K. Park

(57) ABSTRACT

An extrusion cross-section for a straight edge clamping device including (a) an elongated hollow base having a constant cross-section; (b) a first stop fixed at one end of the base; (c) a second stop movably provided along the base; and (d) a clamp for holding the workpieces together, includes a) a flat base portion having top and bottom surfaces, and two edges; b) two L-cross-sectioned portions having horizontal and vertical parts, facing each other, integrated with the flat base on the top surface of the flat base forming a top groove; c) two hollow portions, facing each other, integrated with the flat base on the bottom surface of the flat base forming a bottom groove; and d) two flanges having a horizontal part, vertical parts, facing each other, integrally connected to the corresponding hollow portion, wherein the cross-section has a right-left symmetry with a vertical center line as symmetry axis.

22 Claims, 3 Drawing Sheets

STRAIGHT EDGE CLAMPING DEVICE

BACKGROUND OF THE INVENTION

The present invention relates to an extrusion cross-section for a straight edge clamping device. More particularly, the invention relates to an extrusion cross-section for a straight edge clamping device used to secure workpieces and to guide a power tool along the straight edge. Also, the invention relates to an extrusion cross-section for a straight edge clamping device which is strong and robust to external mechanical strain.

Straight edge clamps are used in wood working for having a straight edge secured to a workpiece or workpieces so that a power tool or a guide for a power tool can be moved along the straight edge, for example, to form a cut edge with a circular hand saw or to form a trimmed edge with a hand router. Also, straight edge clamps are used for the purpose of holding accessory tool against a workpiece, for example, to form pocket holes.

A straight edge clamp by prior art includes a straight edge that is made of extruded aluminum and has an open channel, a fixed stop, a sliding stop that is received in the channel and can slide along the straight edge, and a bar or rod clamp. The sliding stop has a body that is inserted in the channel of the straight edge, and a jaw that protrudes from the body and out of the channel to secure a workpiece.

The shape of the straight edge, thickness of its cross-section, and manufacturing tolerance of extruded aluminum affects the stability of the straight edge when working on workpieces, such as making a cut with a hand circular saw, or hand router, or drilling pocket holes with an attached accessory tool.

When the workpiece are clamped between the fixed stop and the sliding stop with the clamping action of the bar clamp, the jaw of the sliding stop is forced against the workpiece, and the body of the sliding stop binds itself within the channel of the straight edge between the top and bottom surfaces of the channel.

The problem in a straight edge clamp by prior art is that aluminum extrusion products used for making straight edges has a minimum dimension variation of 20 mil, and this variation is the potential amount of movement of the straight edge even when the bar clamp of the straight edge clamp is securely engaged. The problem is inherent in the nature of aluminum extrusion.

The variation is affected by many factors such as shape, size and thickness of the straight edge. Such factors also affect the cost of the extrusion and ultimately the cost of the straight edge. Increasing the thickness of the straight edge for example will decrease the manufacturing dimension variation and increase accuracy and usability of the straight edge clamp. However, it increases the ultimate manufacturing cost of the straight edge clamp beyond practicality.

To solve the problems, optimizing of the mechanical structure is very important. The optimized cross-section of the extrusion can attach the variation problem and the manufacturing cost problem effectively.

Accordingly, there has been a demand for a more stable straight edge clamp with material and thus reduced manufacturing cost.

SUMMARY OF THE INVENTION

The present invention is contrived to overcome the conventional disadvantages. Therefore, an object of the invention is to provide an extrusion cross-section for a straight edge clamp having improved stability of its position while the clamp is engaged while using less material.

Another object of the invention is to provide an extrusion cross-section for a straight edge clamp that enables a power tool to cut a workpiece more accurately when the workpiece is secured by the clamp.

To achieve the objects of the invention for the straight edge clamping device described in the above, an extrusion cross-section is provided for a straight edge clamping device that has an elongated hollow base, first and second stops, and a clamp. The elongated hollow base has a constant cross-section. The first stop is fixed at the first end of the base and the second stop is movably provided along the base. The clamp is for holding the workpieces together.

The extrusion cross-section includes a flat base portion, two L-cross-sectioned portions, two hollow portions, and two flanges.

The flat base has a top surface, a bottom surface, and two edges.

Each of the two L-cross-sectioned portions has a horizontal part and a vertical part, facing each other with a first predetermined interval between horizontal parts and a second predetermined interval between vertical parts, and is integrated with the flat base on the top surface of the flat base forming a partly closed top groove.

The two hollow portions, facing each other with a third predetermined interval, is integrated with the flat base on the bottom surface of the flat base forming a bottom groove.

Each of the two flanges has a horizontal part, one or more vertical parts, facing each other with a fourth predetermined interval between horizontal parts and a fifth predetermined interval between vertical parts, and is integrally connected to the corresponding hollow portion.

The cross-section has a right-left symmetry with a vertical center line as symmetry axis.

To provide structural rigidity and firm interlocking effects, in the general shape of the cross section, the second predetermined interval is larger than the first predetermined interval, the third predetermined interval is larger than the second predetermined interval, the fourth predetermined interval is larger than the third predetermined interval, and the fifth predetermined interval is larger than the fourth predetermined interval.

Preferably, the hollow portion has a triangular cross-section, and the triangle includes a right triangle. The right-triangular hollow portion is integrated with the flat base portion at a vertex with an acute angle, the leg part of the triangle meets the bottom surface of the flat base perpendicularly, and the hypotenuse of the right triangle faces outwardly, and the hollow portion further includes a downward bump at a vertex with a right angle.

The flange is substantially L-shaped. The vertical part of the flange is integrated with an extension of the hypotenuse part of the right-triangular hollow portion.

Each of the vertical parts of the flange includes a shorter vertical part and a longer vertical part.

The first predetermined interval is approximately 0.35 inches, the second predetermined interval is approximately 0.636 inches, the third predetermined interval is approximately 0.8015 inches, wherein the fourth predetermined interval is approximately 1.121 inches, the fifth predetermined interval is approximately 1.645 inches, the width of the flat base portion is approximately 1.121 inches, the height from the top surface of the flat base portion to the bottom of the flange is approximately 0.555 inches, the height of the longer vertical part of the flange is approximately 0.313 inches, and the shorter vertical part of the flange is approximately 0.120 inches. The thickness of the portions is approximately 0.06 inches. The thickness of the horizontal part of the L-cross-sectioned portion is approximately 0.050 inches, the thickness of the leg parts is approximately 0.040 inches, and the thickness of the shorter vertical part of the flange is approximately 0.057 inches. The acute angle of the right triangle is approximately 53.92 degrees.

The extrusion cross-section further includes two bumps on the top surface of the flat base between the two L-cross-sectioned portion.

The base portion further includes two outward bumps, and the outward bumps extend further beyond the hollow portions.

The extrusion cross-section further includes an extension portion between the hollow portion and the L-cross-sectioned portion.

The L-cross-sectioned portion further includes an upward bump, and the upward bump extends upward further beyond the vertical part.

The advantages of the present invention are: (1) the straight edge clamp is kept stable after the workpieces are clamped and during wood working on the workpieces using the extrusion cross-section fro the device due to the shape of the unique cross-section that keeps the base rigid even with reduced cross-sectional area; (2) Woodworking accuracy of the finished product improves; and (3) the improved straight edge clamp can be manufactured with reduced the manufacturing cost appreciably because of the effective extrusion cross-section of the invention.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

The U.S. Pat. No. 6,622,997 of the applicant is incorporated by reference into this disclosure as if fully set fourth herein.

Figure 1:
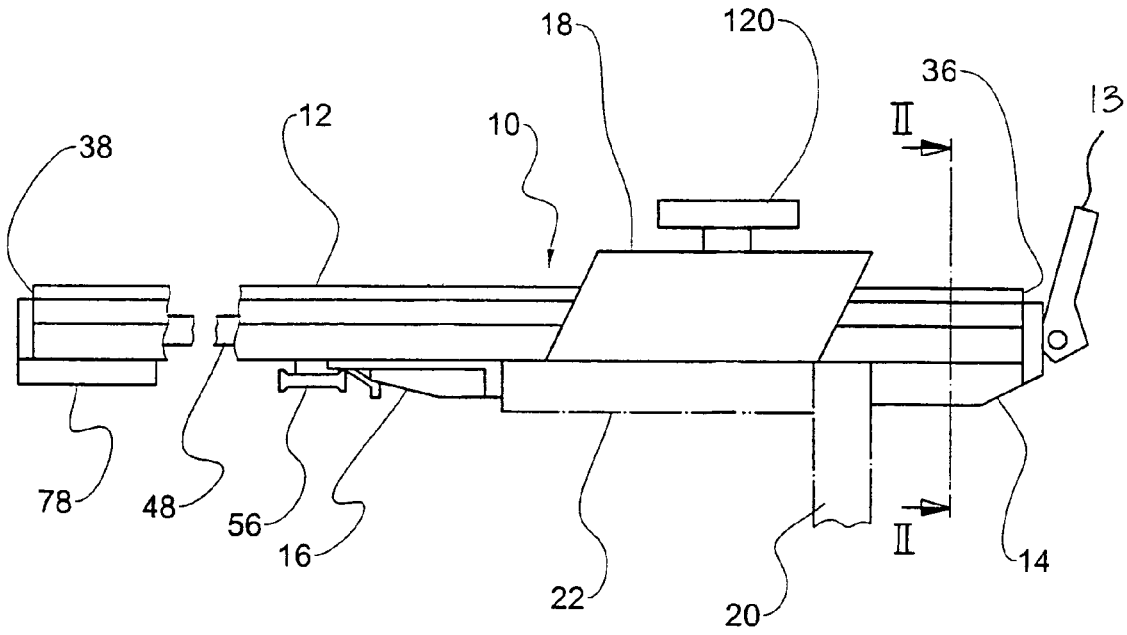
FIG. 1 is a front elevational view of a straight edge clamping device according to an embodiment of the present invention.
Figure 2:
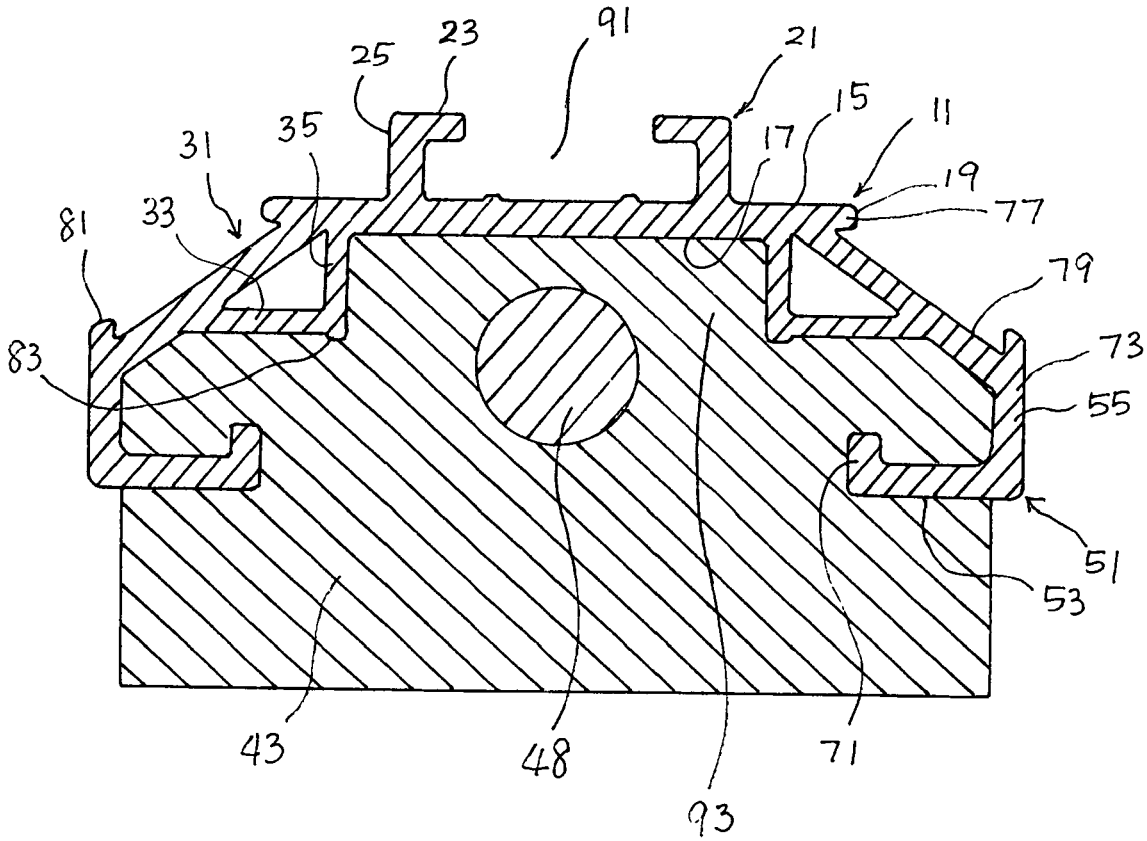
FIG. 2 is a cross-sectional view taken along II-II in FIG. 1.
Figure 3:
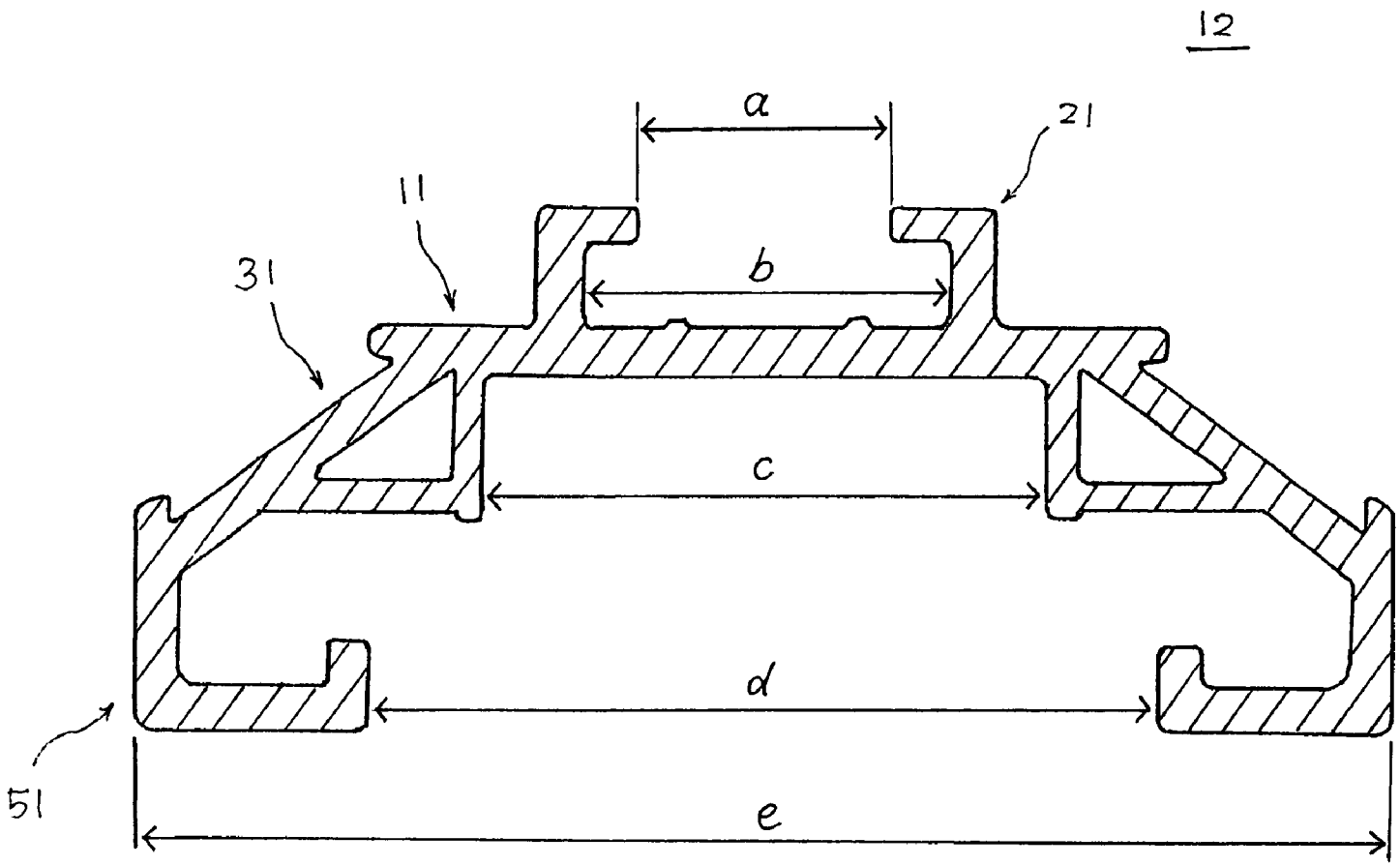
FIG. 3 is an enlarged cross-sectional view showing the cross-section of a base of the straight edge clamping device.

FIG. 1 schematically shows a straight edge clamping device 10 for woodworking. FIGS. 2 and 3 show a cross-section of the straight edge clamping device 10.

For the straight edge clamping device 10, an extrusion cross-section is provided for the straight edge clamping device 10 that has an elongated hollow base 12, first and second stops 14, 16, and a clamp 13. The elongated hollow base 12 has a constant cross-section. The first stop 14 is fixed at an end of the base 12 and the second stop 16 is movably provided along the base 12. The clamp 13 is for holding the workpieces 20, 22 together.

As shown in FIGS. 2 and 3, the extrusion cross-section of the base 12 includes a flat base portion 11, two L-cross-sectioned portions 21, two hollow portions 31, and two flanges 51.

The flat base portion 11 has a top surface 15, a bottom surface 17, and two edges 19.

Each of the two L-cross-sectioned portions 21 has a horizontal part 23 and a vertical part 25, facing each other with a first predetermined interval a between horizontal parts 23 and a second predetermined interval b between vertical parts 25, and is integrated with the flat base portion 11 on the top surface 15 of the flat base portion 11 forming a partly closed top groove 91.

The two hollow portions 31, facing each other with a third predetermined interval c, are integrated with the flat base portion 11 on the bottom surface 17 of the flat base portion 11 forming a bottom groove 93.

Each of the two flanges 51 has a horizontal part 53, one or more vertical parts 55, facing each other with a fourth predetermined interval d between horizontal parts 53 and a fifth predetermined interval e between vertical parts 55, and is integrally connected to the corresponding hollow portion 31.

The cross-section has a right-left symmetry with a vertical center line as symmetry axis.

The second predetermined interval b is larger than the first predetermined interval a, the third predetermined interval c is larger than the second predetermined interval b, the fourth predetermined interval d is larger than the third predetermined interval c, and the fifth predetermined interval e is larger than the fourth predetermined interval d.

The hollow portion 31 has a triangular cross-section, and the triangle includes a right triangle. The right-triangular hollow portion 31 is integrated with the flat base portion 11 at a vertex with an acute angle, the leg part of the triangle meets the bottom surface 17 of the flat base portion 11 perpendicularly, and the hypotenuse of the right triangle faces outwardly.

The flange 51 is substantially L-shaped. The vertical part 55 of the flange 51 is integrated with an extended of the hypotenuse part of the right-triangular hollow portion 31.

Each of the vertical parts 55 of the flange 51 includes a shorter vertical part 71 and a longer vertical part 73. The horizontal parts 53 extend inward toward each other.

In an embodiment, the first predetermined interval is approximately from 0.30 to 0.40 inches, preferably 0.35 inches, the second predetermined interval is approximately from 0.58 to 0.68 inches, preferably 0.636 inches, the third predetermined interval is approximately from 0.75 to 0.85 inches, preferably 0.8015 inches, the fourth predetermined interval is approximately from 1.06 to 1.16 inches, preferably 1.121 inches, the fifth predetermined interval is approximately from 1.59 to 1.69 inches, preferably 1.645 inches, the width of the flat base portion 11 is approximately from 1.07 to 1.17 inches, preferably 1.121 inches, the height from the top surface 15 of the flat base portion 11 to the bottom of the flange 51 is approximately from 0.3 to 0.8 inches, preferably 0.555 inches, the height of the longer vertical part 73 of the flange 51 is approximately from 0.28 to 0.34 inches, preferably 0.313 inches, and the shorter vertical part 71 of the flange 51 is approximately from 0.09 to 0.15 inches, preferably 0.120 inches. The thickness of the portions is approximately from 0.04 to 0.08 inches, preferably 0.06 inches. The thickness of the horizontal part 23 of the L-cross-sectioned portion 21 is approximately from 0.03 to 0.07 inches, preferably 0.050 inches, the thickness of the leg parts 33, 35 of the hollow portion 31 is approximately from 0.02 to 0.06 inches, preferably 0.040 inches, and the thickness of the shorter vertical part 71 of the flange 51 is approximately from 0.03 to 0.08 inches, preferably 0.057 inches. The acute angle of the right triangle is approximately from 52 to 56 degrees, preferably 53.92 degrees.

The extrusion cross-section further includes two bumps 75 on the top surface 15 of the flat base portion 11 between the two L-cross-sectioned portions 21.

The flat base portion 11 further includes two outward bumps 77, and the outward bumps 77 extend further beyond the hollow portions 31.

The extrusion cross-section further includes an extension portion 79 between the hollow portion 31 and the L-cross-sectioned portion 51.

The L-cross-sectioned portion 51 further includes an upward bump 81, and the upward bump 81 extends upward further beyond the vertical part 73 of the L-cross-sectioned portion 51.

The hollow portion 31 has a right triangular cross-section, the right-triangular hollow portion 31 is integrated with the flat base portion 11 at a vertex with an acute angle, the leg part 33, 35 of the triangle meets the bottom surface 17 of the flat base 11 perpendicularly, the hypotenuse of the right triangle faces outwardly, and the hollow portion 31 further includes a downward bump 83 at a vertex with a right angle.

The unique combination of geometrical constraints of the invention provides a stable base 12 with reduced material while providing required rigidity and effective interlocking effects with parts guided by or fixed to the base 12.

Referring back to FIG. 1, the straight edge clamping device 10, includes the elongated hollow base 12 having a constant cross-section. The base 12 includes the flat base portion 11, two L-cross-sectioned portions 21, two hollow portions 31, and two flanges 51.

As a specific example of application of the unique cross-section, the straight edge clamping device 10 may further include a drill guide 18, an end cap 78, a handle 56 of the second stop 16, a knob 120 for tightening the workpiece 20, and a rod 48 along which the stops 14, 16 slide. The portion of the first stop 14 forms a stop 43. The stop 43 contacts the workpiece 20. The rod 48 is received within the channel form by the bottom groove 93 of the base 12.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A straight edge clamping device comprising (a) an elongated hollow base having a constant cross-section; and (b) a clamping device for holding a workpiece on the base, wherein the cross-section of the base comprising:

a) a flat base portion having a top surface, a bottom surface, and two edges; and b) two flanges having a horizontal part, one or more vertical parts, facing each other with a fourth predetermined interval between horizontal parts and a fifth predetermined interval between vertical parts, integrally connected to the corresponding hollow portion.

2. The straight edge clamping device of claim 1, further comprising:

a) two L-cross-sectioned portions having a horizontal part and a vertical part, facing each other with a first predetermined interval between horizontal parts and a second predetermined interval between vertical parts, integrated with the flat base portion on the top surface of the flat base portion forming a partly closed top groove; and b) two hollow portions, facing each other with a third predetermined interval, integrated with the flat base portion on the bottom surface of the flat base portion forming a bottom groove.

3. The straight edge clamping device of claim 2, wherein the second predetermined interval is larger than the first predetermined interval, wherein the third predetermined interval is larger than the second predetermined interval, wherein the fourth predetermined interval is larger than the third predetermined interval, wherein the fifth predetermined interval is larger than the fourth predetermined interval.

4. The straight edge clamping device of claim 2, wherein the hollow portion has a triangular cross-section.

5. The straight edge clamping device of claim 4, wherein the triangle comprises a right triangle.

6. The straight edge clamping device of claim 5, wherein the right-triangular hollow portion is integrated with the flat base portion at a vertex with an acute angle, wherein the leg part of the triangle meets the bottom surface of the flat base portion perpendicularly, wherein the hypotenuse of the right triangle faces outwardly.

7. The straight edge clamping device of claim 6, wherein the flange is substantially L-shaped.

8. The straight edge clamping device of claim 7, wherein the L-shaped flanges faces each other, wherein the vertical part of the flange is integrated with an extension of the hypotenuse part of the right-triangular hollow portion.

9. The straight edge clamping device of claim 6, wherein the hollow portion further comprises a downward bump at a vertex with a right angle.

10. The straight edge clamping device of claim 2, wherein the vertical parts of the flange comprise a shorter vertical part and a longer vertical part.

11. The straight edge clamping device of claim 10, wherein the first predetermined interval is approximately from 0.30 to 0.40 inches, preferably 0.35 inches, the second predetermined interval is approximately from 0.58 to 0.68 inches, preferably 0.636 inches, the third predetermined interval is approximately from 0.75 to 0.85 inches, preferably 0.8015 inches, the fourth predetermined interval is approximately from 1.06 to 1.16 inches, preferably 1.121 inches, the fifth predetermined interval is approximately from 1.59 to 1.69 inches, preferably 1.645 inches, the width of the flat base portion is approximately from 1.07 to 1.17 inches, preferably 1.121 inches, the height from the top surface of the flat base portion to the bottom of the flange is approximately from 0.3 to 0.8 inches, preferably 0.555 inches, the height of the longer vertical part of the flange is approximately from 0.28 to 0.34 inches, preferably 0.313 inches, and the shorter vertical part of the flange is approximately from 0.09 to 0.15 inches, preferably 0.120 inches.

12. The straight edge clamping device of claim 11, wherein the thickness of the portions is approximately from 0.04 to 0.08 inches, preferably 0.06 inches.

13. The straight edge clamping device of claim 12, wherein the thickness of the horizontal part of the L-cross-sectioned portion is approximately from 0.03 to 0.07 inches, preferably 0.050 inches, the thickness of the leg parts of the hollow portion is approximately from 0.02 to 0.06 inches, preferably 0.040 inches, and the thickness of the shorter vertical part of the flange is approximately from 0.03 to 0.08 inches, preferably 0.057 inches.

14. The straight edge clamping device of claim 11, wherein the acute angle of the right triangle is approximately from 52 to 56 degrees, preferably 53.92 degrees.

15. The straight edge clamping device of claim 1, further comprising one or more bumps on the top surface of the flat base portion between the two L-cross-sectioned portions.

16. The straight edge clamping device of claim 1, wherein the base portion further comprises two outward bumps, wherein the outward bumps extend further beyond the hollow portions.

17. The straight edge clamping device of claim 1, further comprising an extension portion between the hollow portion and the L-cross-sectioned portion.

18. The straight edge clamping device of claim 1, wherein the L-cross-sectioned portion further comprises an upward bump, wherein the upward bump extends upward further beyond the vertical part.

19. The straight edge clamping device of claim 1, further comprising:

a) a first stop fixed at the first end of the base;

b) a second stop movably provided along the base; and c) a clamp for holding the workpieces together.

20. The straight edge clamping device of claim 19, wherein the second stop has a body movably received in the channel of the base and a stop for securing the workpieces, wherein the body of the second stop has a shape reverse to the shape of the channel of the base so that the body and the channel interlock.

21. The straight edge clamping device of claim 1, further comprising:

(a) a first stop fixed at the first end of the base;

(b) a second stop movably provided along the base; and (c) a clamp for holding the workpieces together.

22. The straight edge clamping device of claim 1, wherein the cross-section has a right-left symmetry with a vertical center line as symmetry axis.

* * * * *

US007484306C1

(12) EX PARTE REEXAMINATION CERTIFICATE (9005th)

United States Patent
Emerson

(10) Number: US 7,484,306 C1
(45) Certificate Issued: May 8, 2012

(54) STRAIGHT EDGE CLAMPING DEVICE

(76) Inventor: Eugene Emerson, Whittier, CA (US)

Reexamination Request:
No. 90/011,456, Jan. 25, 2011

Reexamination Certificate for:

| | |
|---|---|
| Patent No.: | **7,484,306** |
| Issued: | **Feb. 3, 2009** |
| Appl. No.: | **11/272,495** |
| Filed: | **Nov. 14, 2005** |

(51) Int. Cl.
*B43L 7/00* (2006.01)

(52) U.S. Cl. ..... 33/403; 33/430
(58) Field of Classification Search ..... None
See application file for complete search history.

(56) References Cited

To view the complete listing of prior art documents cited during the proceeding for Reexamination Control Number 90/011,456, please refer to the USPTO's public Patent Application Information Retrieval (PAIR) system under the Display References tab.

*Primary Examiner*—Mark Sager

(57) ABSTRACT

An extrusion cross-section for a straight edge clamping device including (a) an elongated hollow base having a constant cross-section; (b) a first stop fixed at one end of the base; (c) a second stop movably provided along the base; and (d) a clamp for holding the workpieces together, includes a) a flat base portion having top and bottom surfaces, and two edges; b) two L-cross-sectioned portions having horizontal and vertical parts, facing each other, integrated with the flat base on the top surface of the flat base forming a top groove; c) two hollow portions, facing each other, integrated with the flat base on the bottom surface of the flat base forming a bottom groove; and d) two flanges having a horizontal part, vertical parts, facing each other, integrally connected to the corresponding hollow portion, wherein the cross-section has a right-left symmetry with a vertical center line as symmetry axis.

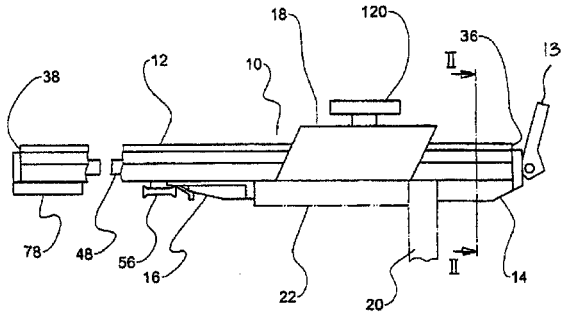

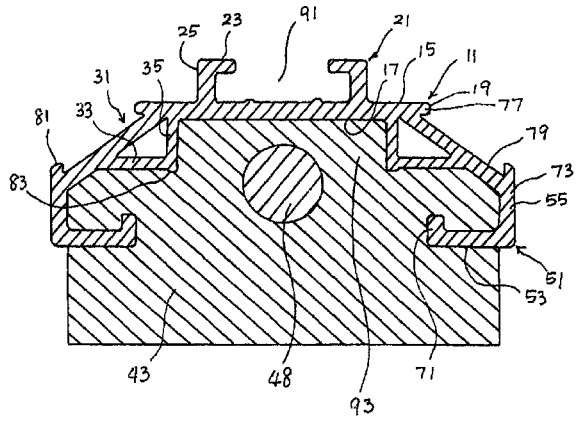

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1 and 19-22 are cancelled.

Claims 2-18 were not reexamined.

* * * * *